United States Patent [19]

Willhoite et al.

[11] Patent Number: 4,802,391

[45] Date of Patent: Feb. 7, 1989

[54] TOOL FOR RECREATIONAL VEHICLE

[76] Inventors: Stanley K. Willhoite; Thomas G. McMennamy, both of Rte. 1, Box 188A, Temple, Tex. 76501

[21] Appl. No.: 100,475

[22] Filed: Sep. 24, 1987

[51] Int. Cl.[4] ..... B25B 33/00

[52] U.S. Cl. ..... 81/488; 29/278; 294/18

[58] Field of Search ..... 7/100, 169, 170; 29/278; 81/488; 294/18, 19.1, 24

[56] References Cited

U.S. PATENT DOCUMENTS

| | | | |
|---|---|---|---|
| 2,072,391 | 3/1937 | Varney, Jr. | 7/169 X |
| 2,999,310 | 9/1961 | Pope | 294/18 |
| 3,641,657 | 2/1972 | Shufflebarger | 29/278 |
| 4,572,040 | 2/1986 | Metz | 7/100 X |

*Primary Examiner*—James G. Smith

*Attorney, Agent, or Firm*—Webner, Kurz & Bergert Nies

[57] ABSTRACT

A hand tool for use to assist in connecting and operating the sewer hose and sewer gate valve of a recreational vehicle is disclosed. The tool is in the form of an elongated rod having a handle at one end and a two prong hook at the other end. An upright wall member is mounted on the rod adjacent to and facing the hook. A cross bar member is mounted on the rod at a position intermediate the ends thereof, and the cross bar is provided with a flange at each end for use in engaging the sewer hose connector arms normally installed at the end of a sewer hose. The two prong hook and adjacent wall member are advantageously employed in opening and closing the sewer gate valve.

11 Claims, 2 Drawing Sheets

TOOL FOR RECREATIONAL VEHICLE

BACKGROUND AND SUMMARY OF THE INVENTION

The present invention relates to a tool for use to assist as a sewer hose connector for a recreational vehicle. More particularly, the present invention relates to a hand tool for use to assist in connecting a hose employed in the removal of sewage from a travel trailer or motor home or other vehicle, with the tool also being useful in opening and closing the gate valve which controls the flow of materials through the sewer hose.

In the operation of recreational vehicles such as motor homes and the like, there has been a need for a hand tool to facilitate the connection of the sewer hose upon arrival at the destination and also to provide for opening and closing of the gate valve which is usually located under the body of the vehicle. By the present invention, there is provided a hand tool which is lightweight and easy to use and which facilitates removal and replacement of the sewer hose within the rear bumper where it is often stored, as well as to assist in connection of the sewer hose and the operation of the gate valve which controls the flow of materials through the sewer hose. The tool of the present invention allows the operation of such equipment without the necessity for the operator to get down on his or her hands and knees to reach under the vehicle to connect the sewer hose and to open or close the gate valve.

Accordingly, it is an object of the present invention to provide a hand tool constructed so as to fit internal to a sewer connector hose commonly stored in the rear tubular bumper of a recreational vehicle.

It is a further object of the invention to provide a tool having a hook on one end for use in the operation of a sewer gate valve on a recreational vehicle.

It is an additional object of the invention to provide a lightweight tool which may be easily stored in a recreational vehicle for use in connecting and disconnecting sewer hose equipment of a recreational vehicle.

It is a further object of the invention to provide a hand tool which eliminates the necessity for the operator to assume various awkward positions in order to connect and disconnect sewage removal equipment for a recreational vehicle.

DESCRIPTION OF THE PREFERRED EMBODIMENTS

Figure 2:
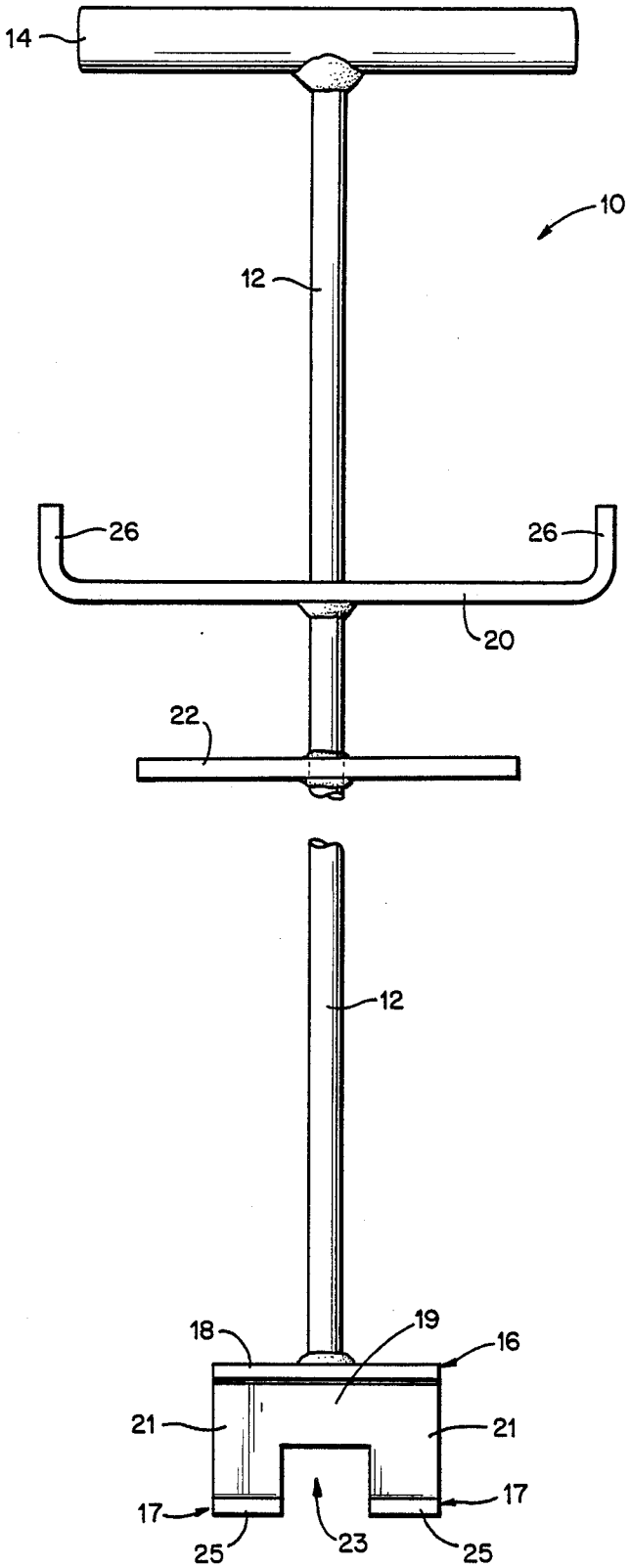
FIG. 2 is a side view in elevation of the hand tool of FIG. 1.
Figure 3:
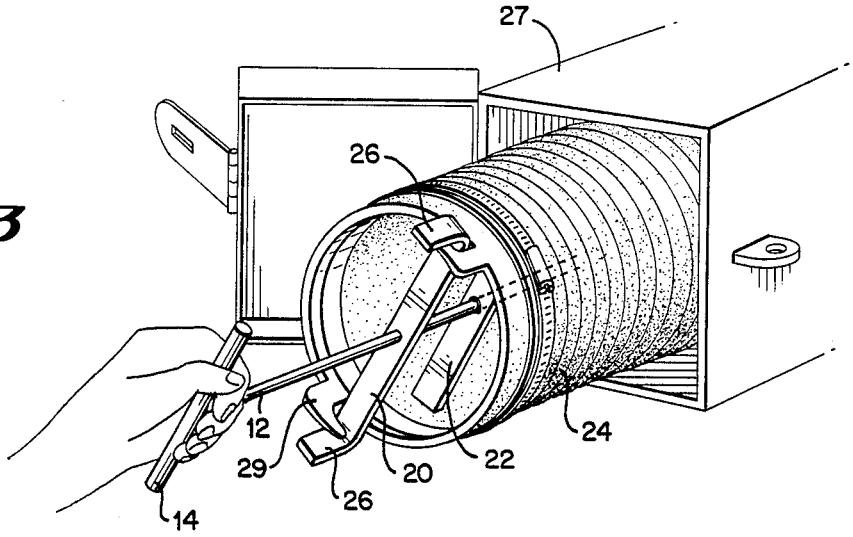
FIG. 3 is a perspective view showing a portion of one end of the hand tool as installed in the end of a sewer hose.
Figure 4:
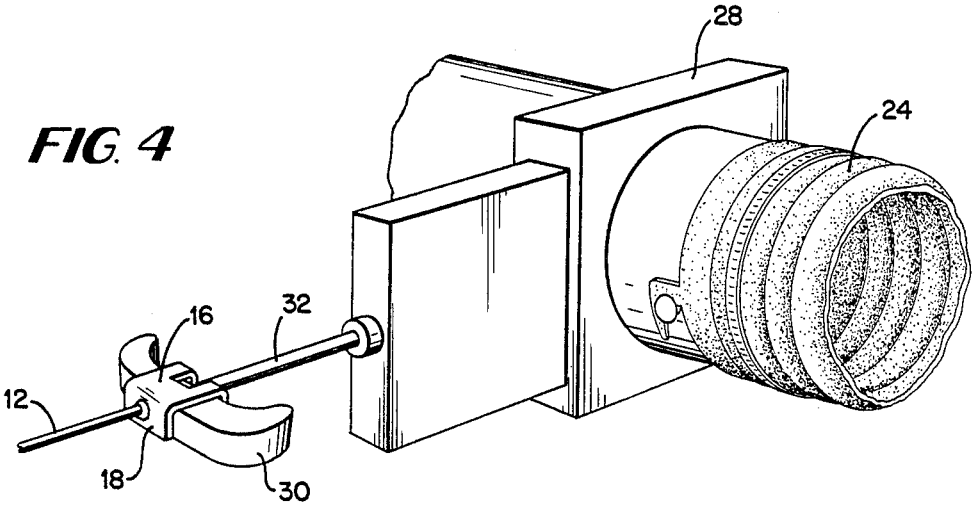
FIG. 4 is a perspective view showing a portion of the opposite end of the hand tool in the operation of a gate valve for a recreational vehicle.

In the embodiment of the present invention as shown in FIGS. 1 through 4, there is provided a hand tool 10 in the form of an elongated rod 12 having a hand grip handle 14 installed transversely on one end and a two-prong or bifurcated hook 16 on the opposite end. An upright wall member 18 is installed so as to face the hook 16 adjacent thereto. The two-prong hook 16 includes a pair of L-shaped portions 17 joined by a connecting flange 19, with each member 17 having one arm 21 thereof attached to the wall member 18 so as to be perpendicular thereto. The length of the flange 19 is shorter than the arms 17 so as to provide a notch 23 between the arms 17. The outer arms 25 of the L-shaped members 17 are thus parallel to the plane of the wall member 18. This configuration is advantageous in allowing the hook end of the tool to firmly grip and control the gate valve handle 30, as shown in FIG. 4.

Intermediate to the two ends is a cross bar member 20 which can be locked on to the end of the sewer hose connector arms 29, as shown in FIG. 3, so that the sewer hose 24 can be pushed in or pulled out of the storage area in the rear bumper 27 of a recreational vehicle by grasping the hand grip 14. A second cross bar 22 is located between the main cross bar 20 and the two-pronged hook 16 of the tool for use in providing stability when the tool 10 is positioned within the sewer hose.

The main cross bar member 20 has a short flange 26 at each end thereof, with such flanges 26 extending generally parallel to the rod 12 in the direction of the handle 14. These flanges 26 are for use in engaging the sewer hose connector arms 29 which are normally installed at the end of a sewer hose 24. The connector arms 29 facilitate attachment of the end of the hose to the gate valve 28.

Figure 1:
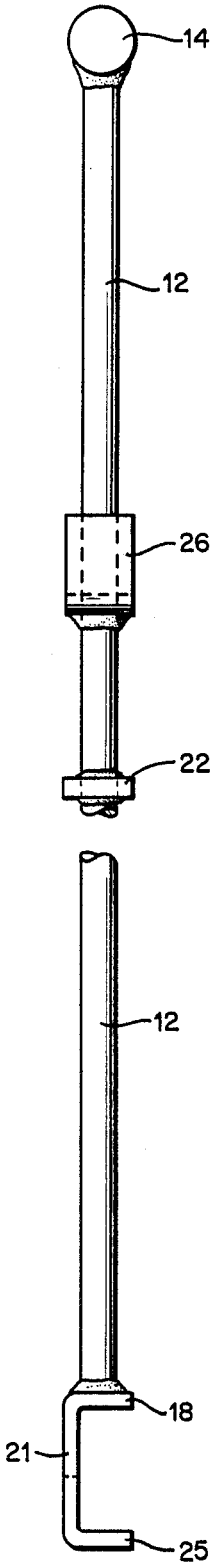
FIG. 1 is a front view in elevation of the hand tool of the present invention.

As shown in FIGS. 1 and 2, in one embodiment the handle 14 lies in a common plane with the cross bar members 20 and 22 for easier use of the tool as well as for storage purposes.

As shown in FIG. 4, the two-prong portion 16 of the tool 10 engages the handle 30 and rod 32 of the gate valve 28 for use in opening the valve 28 while the upright wall member portion 18 is employed to push the handle 30 and rod 32 of the valve inwardly so as to close the valve.

The hand tool 10 of the present invention may be constructed of a metal such as steel or a durable plastic material. The tool 10 is easily stored within the recreational vehicle until needed. The location and shape of the various components assists in providing a tool which is durable, easy to use and well suited for its intended purpose.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changed which come within the meaning and range of equivalency of the claims are therefore intended to be embraced therein.

What is claimed and desired to be secured by Letters Patent is:

1. A hand tool for use to assist in connecting and operating the sewer hose and sewer gate valve of a recreational vehicle, comprising:

an elongated rod having a handle at one end and a two prong hook at the other end; an upright wall member mounted on said rod adjacent to and facing said hook; and a cross bar member secured to said rod at a position intermediate said ends, said cross bar member having a flange at each end which extends generally parallel to said rod.

2. The hand tool of claim 1 further including a second cross bar member secured to said rod at a position between said flanged cross bar and said rod end having the two prong hook, said flanged cross bar being longer than said second cross bar so as to extend outwardly from said rod in either direction a greater distance than said second cross bar.

3. The hand tool of claim 2 wherein said handle is in the form of a bar member extending transverse to said rod.

4. The hand tool of claim 2 wherein said upright wall member is secured to the respective end of said rod so as to extend generally perpendicular thereto and wherein said two prong hook is in the form of a pair of parallel L-shaped members secured to said upright wall member.

5. The hand tool of claim 2 wherein said handle lies in a common plane with said flanged cross bar and said second cross bar.

6. The hand tool of claim 3 wherein said handle lies in a common plane with said flanged cross bar and said second cross bar.

7. The hand tool of claim 4 wherein said handle lies in a common plane with said flanged cross bar and said second cross bar.

8. The hand tool of claim 4 wherein said L-shaped members have one arm thereof extending perpendicular to said upright wall member and an outer arm extending parallel to the plane of said wall member.

9. The hand tool of claim 1 wherein said upright wall member is secured to the respective end of said rod so as to extend generally perpendicular thereto and wherein said two prong hook is in the form of a pair of parallel L-shaped members secured to said upright wall member.

10. The hand tool of claim 9 wherein said L-shaped members have one arm thereof extending perpendicular to said upright wall member and an outer arm extending parallel to the plane of said wall member.

11. The hand tool of claim 1 wherein said flanges at the ends of said cross bar extend in the direction of the rod end having the handle.

* * * * *